US006415199B1

(12) United States Patent
Liebermann

(10) Patent No.: US 6,415,199 B1
(45) Date of Patent: Jul. 2, 2002

(54) METHOD AND APPARATUS FOR PREPARING CUSTOM-FITTED CLOTHING

(75) Inventor: Gabriel S. A. Liebermann, Narberth, PA (US)

(73) Assignee: E-Z Max Apparel Systems, Inc., Narberth, PA (US)

( * ) Notice: Subject to any disclaimer, the term of this patent is extended or adjusted under 35 U.S.C. 154(b) by 0 days.

(21) Appl. No.: 09/257,573

(22) Filed: Feb. 25, 1999

(51) Int. Cl.[7] ..... G06F 17/00
(52) U.S. Cl. ..... 700/132; 33/512
(58) Field of Search ..... 700/132, 130; 33/512, 758, 759, 762, 755; 705/1, 26; 2/227, 269; 116/200

(56) References Cited

U.S. PATENT DOCUMENTS

| | | | | | |
|---|---|---|---|---|---|
| 3,601,817 | A | * | 8/1971 | Abrams | 2/227 |
| 3,685,155 | A | * | 8/1972 | Oblander | 33/11 |
| 4,293,959 | A | | 10/1981 | Gioello | |
| 4,635,367 | A | * | 1/1987 | Vigede | 33/512 X |
| 4,875,296 | A | * | 10/1989 | Holzmeister et al. | 33/512 X |
| 4,885,844 | A | | 12/1989 | Chun | |
| 4,916,634 | A | | 4/1990 | Collins et al. | |
| 5,163,007 | A | | 11/1992 | Slilaty | |
| 5,515,268 | A | * | 5/1996 | Yoda | 705/1 |
| 5,530,652 | A | | 6/1996 | Croyle et al. | |
| 5,548,519 | A | | 8/1996 | Park et al. | |
| 5,680,314 | A | | 10/1997 | Patterson et al. | |
| 5,680,528 | A | | 10/1997 | Korszun | |
| 5,757,661 | A | | 5/1998 | Surville | |
| 5,768,135 | A | | 6/1998 | Park et al. | |
| 5,996,240 | A | * | 12/1999 | Casper | 33/759 |
| 6,237,239 | B1 | * | 5/2001 | Miyazaki | 33/512 |

OTHER PUBLICATIONS

Sullivan, J. "Nice Pants" (Levi's Personal Pair), *Wired*, Aug. 1997, p. 131.

SewSoft™ User's Manual, Version 1.5, Andros Software, 1988, 45 pages.

* cited by examiner

*Primary Examiner*—Peter Nerbun
(74) *Attorney, Agent, or Firm*—Morgan, Lewis & Bockius LLP

(57) ABSTRACT

A stretch bodysuit is provided which allows precise measurements of the proportions of the portion of the body enclosed by the bodysuit. Specific benchmarks and lines are positioned at key locations on the bodysuit. These benchmarks and lines may be aligned with or positioned to coincide with critical measuring points such as joints or other bodily features. The benchmarks act as a guide for using a tape measure. Alternatively, the bodysuit and the lines and benchmarks thereon may be produced in such a fashion as to facilitate optical scanning of the suit. Once the dimensions have been recorded, a computer program uses the dimensions to generate a pattern for the desired garment.

20 Claims, 17 Drawing Sheets

10 FR-WAIST

12 BK-RISE

13 FULL RISE

1A INSEAM

1 SD-WAIST

2 BB-WAIST

3 HIP

4 SEAT

5 THIGH

6 M-THIGH

7 KNEE

8 CALF

9 ANKLE

11 BK-WAIST

FIG.18

METHOD AND APPARATUS FOR PREPARING CUSTOM-FITTED CLOTHING

BACKGROUND OF THE INVENTION

It has long been a goal of the garment industry to provide custom-fit or made-to-measure clothing on a mass level. Of course, custom-tailored clothing has long been available to those who can afford the high cost of having a tailor measure the dimensions of their body and produce—through a series of fittings and additional measurements—clothing that is customized to fit to their exact dimensions. However, with the advent of catalog and Internet shopping, a significant need has arisen in the garment industry to acquire accurate measurements directly from the customer in order to find the proper ready-to-wear item or to either alter or make a garment to order.

The difficulty in providing more extensive access to custom-tailored clothing is twofold. First, it is difficult to obtain the precise measurements of the customer's physical dimensions without consuming substantial amounts of the seller's time. Thus, in order to obtain the measurements, a seller must have a large staff capable of taking and recording a multitude of exact measurements of the customer's body. Such a large staff dramatically increases the seller's overhead costs. These costs are, of course, transferred to the buyer, increasing the cost of the clothing, often to a degree prohibitive to most customers.

Second, once a set of exact measurements is obtained, the tailor must construct a set of patterns based on those measurements which fit the customer well by allowing for freedom of movement of the customer's limbs. Traditionally, a tailor works with a muslin pattern based on the original measurements and, through at least one iteration, i.e., the fitting, adjusts the measurements to account for freedom of movement. Thus, the customer must visit the tailor for at least two sets of measurements, the original set and the fitting, before he or she can expect to receive the finished garment. Not only are the costs of the garment increased due to the expense of providing a tailor to perform the fitting, the customer is inconvenienced as a result of the need to appear at least twice at the seller's outlet.

Apart from time and cost considerations, custom-tailoring is a very invasive process involving a great deal of contact, often uncomfortable, between the tailor and the buyer. The invasion of privacy inherent in the custom-tailoring process discourages many potential buyers.

Numerous methods of automating the measurement and pattern-producing process have been proposed. For example, U.S. Pat. No. 4,293,959 discloses a stretch bodysuit to which muslin panels are attached in order to create patterns for clothing which will perfectly fit the wearer of the bodysuit. While this approach effectively produces patterns for custom-fitted clothing, it still requires custom application of muslin panels to the wearer—a time-consuming and inefficient process. Similarly, the Levi's Corporation has introduced a "custom-fit" program for providing custom-fitted trousers to customers. In reality, this program merely provides a very large number of model trousers, as many as 400 in a given location, from which the buyer selects the trousers which fit most closely to his or her body. While this approach does not require the presence of an expert tailor to perform a fitting, the process of selecting the appropriate trousers may still be time-consuming. Furthermore, maintaining a trial inventory of up to 400 trousers at the retail outlet may be a substantial burden to the seller.

Consequently, it is desirable to provide a method for rapidly, accurately, and privately taking the precise measurements of a buyer's bodily dimensions. It is further desirable to provide a means for measuring the buyer's dimensions once and producing a custom pattern from which garments may be produced without the need for additional measurements or fittings. To accomplish this goal, it is important to eliminate as many potential errors in the measurement acquisition process as possible. It is also desirable to provide a measuring system whereby the user can continuously update existing measurements and take new ones if needed.

SUMMARY OF THE INVENTION

The measurement acquisition system of the present invention includes a stretch bodysuit marked so as to allow for precise measurements of portions of the body enclosed by the bodysuit. Specific benchmarks are located at key points in the bodysuit which are aligned with or positioned to coincide with critical measuring points, such as joints or other body features. The benchmarks act as guidelines for placing a tape measure or other measuring device on the body to determine the dimensions required to fit a garment, such as the circumference of the waistline, thigh, seat, and other relevant dimensions. A series of lines interconnect the benchmarks to provide similar guidance for measuring inseams, outseams, sleeve lengths, and other equally important dimensions. The tape measure used with the suit may include a rigid extension upon which the customer stands and/or a sliding indicator in order to simplify and improve the accuracy of the measurement acquisition process.

Alternatively, the bodysuit and the lines and benchmarks thereon may be produced in such a fashion as to facilitate optical scanning of the suit. A computer program is then provided which analyzes the scanned image and determines the critical measurements. In another embodiment, the bodysuit may contain sensors incorporated directly therein that generate a signal corresponding to the desired measurements. The customer's measurements can thus be determined automatically, without the need for time-consuming manual measuring. In yet another embodiment, elastic bands positioned along critical measurement locations are marked in such a manner that the deformation of the elastic band, which is proportional to the measurement being taken, distorts the markings such that a marking corresponding to the accurate measurement of the particular body part is visibly distinct from the other markings.

Other embodiments of the invention allow for accurate measurement acquisition without the use of the bodysuit. One such embodiment provides for direct application of adhesive measuring tape to the customer's skin or undergarment. In another embodiment, numbered labels indicating the corresponding body part name are adhered to the customer's skin or undergarment to guide the user in taking the critical measurements.

Once the dimensions have been recorded, either automatically or manually, a computer program uses the dimensions to generate a pattern for the desired garment. The program may be resident on the user's computer. Alternatively, the user may transmit the dimensions to the central facility, whereupon a computer program at the central facility creates the pattern and directs the textile machinery to produce the garment.

It is therefore an object of the present invention to provide a means for rapidly, accurately, and privately taking precise measurements of a person's bodily dimensions.

It is a further object of the present invention to provide a means for producing a custom pattern from which garments may be produced without the need for additional measurements or fittings.

Another object of this invention is to provide a system for rapidly and accurately taking precise measurements of a person's bodily dimensions without the need for manual observation or recordation of the desired dimensions.

A further object of the present invention is to provide an integrated system for taking bodily measurements, generating custom patterns, and producing custom fitted clothing.

Yet another object of the invention is to provide a system whereby customized measurements of individuals may be taken and forwarded to a centralized site for manufacturing custom-fitted clothing or fitting ready-to-wear garments.

Other objects, features, and advantages of the present invention will become apparent with reference to the remainder of the written portion and the drawings of this application, which are intended to exemplify and not to limit the invention.

BRIEF DESCRIPTION OF THE DRAWINGS

FIG. 18 shows the various labels for adherence to the critical body parts as indicated in FIG. 17.

DETAILED DESCRIPTION

Figure 1:
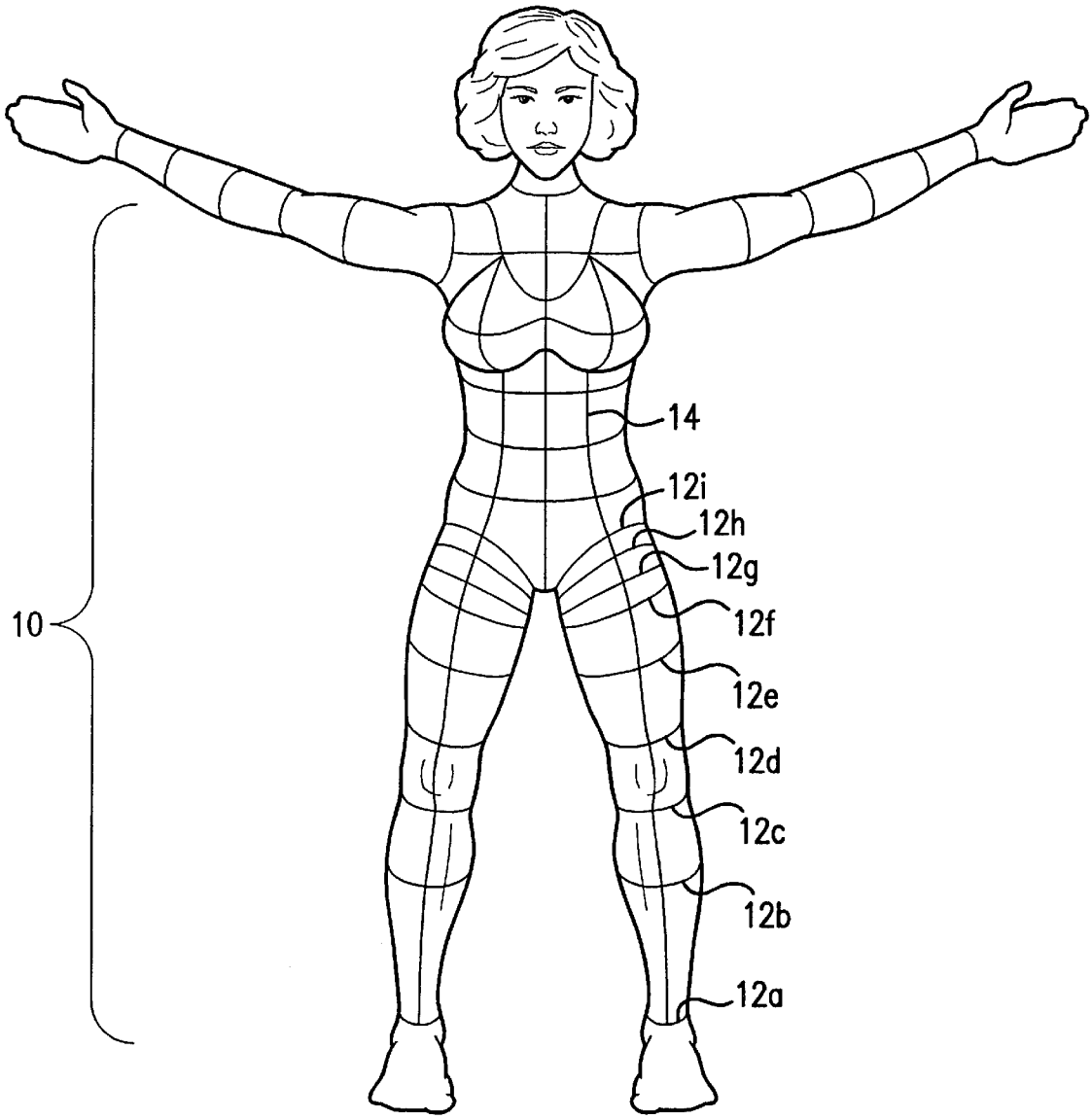
FIG. 1 is front view of a stretch bodysuit in accordance with the present invention.
Figure 2:
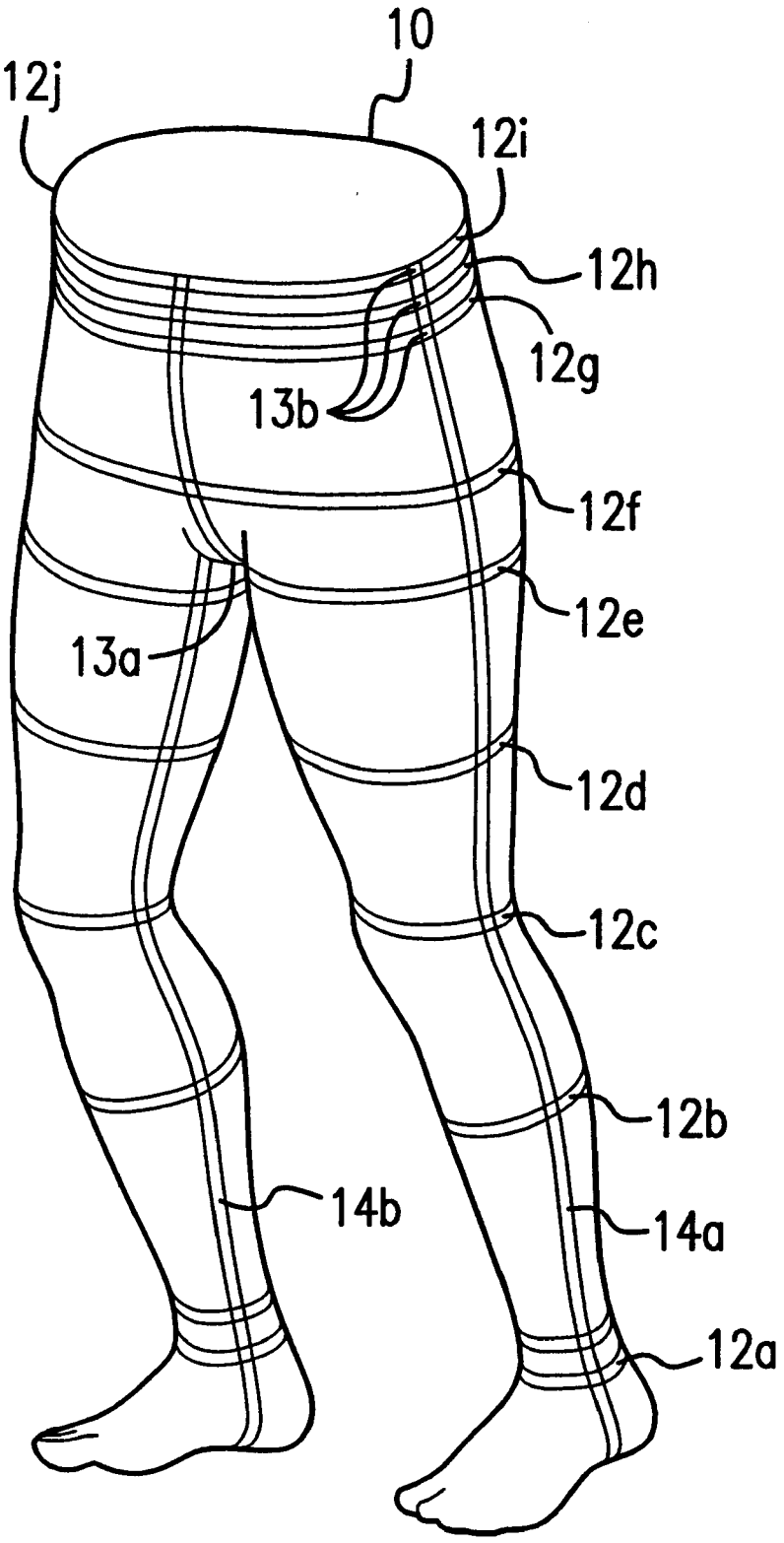
FIG. 2 is a perspective view of a first alternate embodiment of the stretch bodysuit of FIG. 1.
Figure 3:
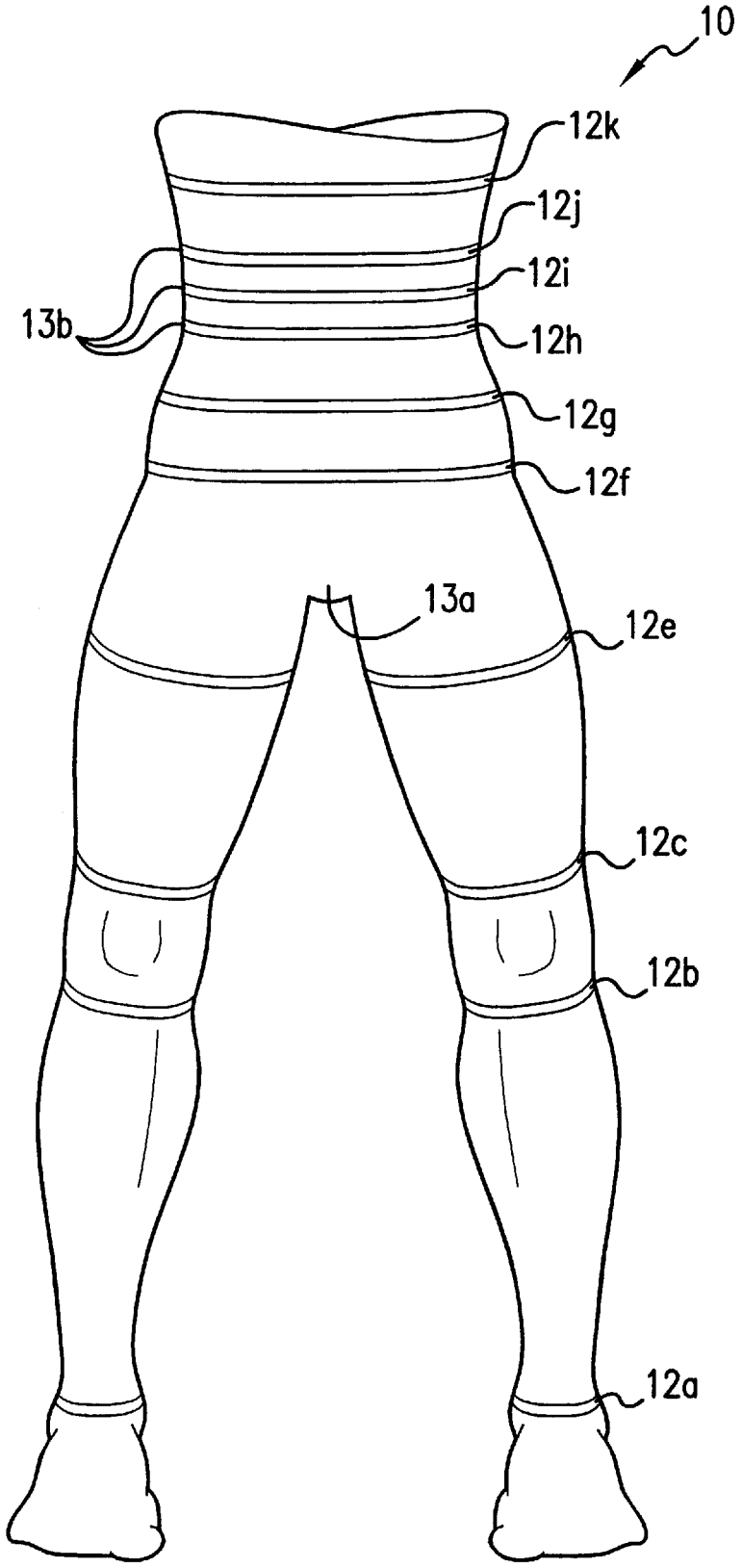
FIG. 3 is a front view of the bodysuit of FIG. 2.
Figure 4:
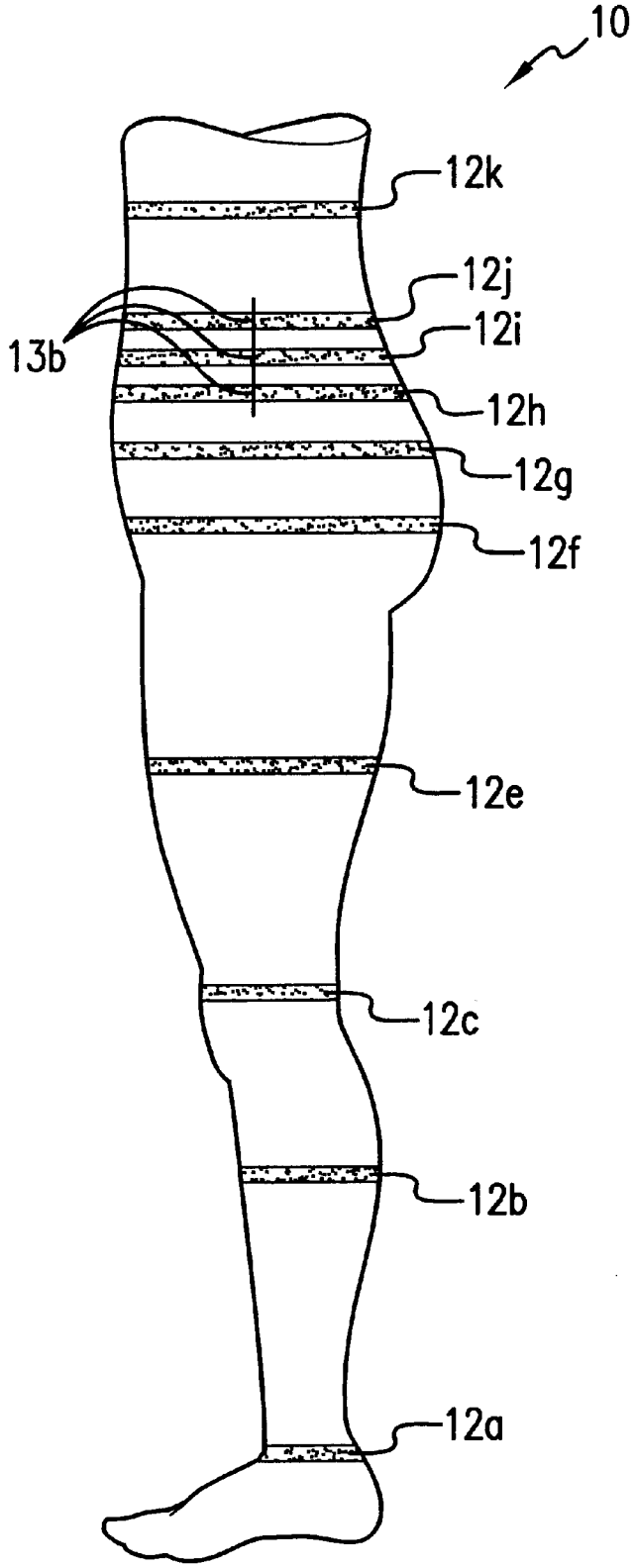
FIG. 4 is a side view of the bodysuit of FIG. 2.

FIGS. 1–8 illustrate a bodysuit 10 in accordance with the present invention. Bodysuit 10 is made of lycra™, nylon or any other suitable stretchable fabric that tightly conforms to the shape of the portion of a body which it encloses. FIG. 1 illustrates a bodysuit 10 which encloses the entire body of the user; however, partial bodysuits, as shown in FIGS. 2–4, may be provided which enclose only portions of the body, such as the legs. Other partial bodysuits (not shown) may be provided for covering only the torso or any other portion of the body for which garments may be made.

Bodysuit 10 is marked with a plurality of benchmarks 12*a–n,* in which "n" is variable and may be selected as desired or appropriate to provide sufficient benchmarks to allow the proper positioning and measuring as described below. Benchmarks 12*a–n* may be removable or permanent. For example, benchmarks 12*a–n* may be applied by printing, dyeing, weaving, stitching or otherwise affixing them to the fabric of bodysuit 10. Benchmarks 12*a–n* may be bars, stripes, lines, dots or any other suitable means for highlighting specific locations on bodysuit 10. Referring to FIGS. 5–8, benchmarks 12*a–n* may be labeled with identifying crosshairs 13, which, as described in more detail below, assist the user in taking measurements and, moreover, will allow an optical scanner to differentiate the different benchmarks 12*a–n.*

Benchmarks 12*a–n* are positioned to reflect the measuring points necessary to create or modify patterns for a particular garment. For instance, referring to FIGS. 2–4, if measurements are being taken for pants or trousers, benchmarks 12*a–n* are positioned at the hips (12*f, g*), ankles (12*a*), waist (12*h–j*), knees (12*c*), and other relevant locations.

Referring to FIG. 1, a plurality of reference lines 14 may interconnect benchmarks 12*a–n.* Reference lines 14 are provided along dimensions typically measured for the production of garments and garment patterns. For instance, reference lines 14 may be provided along the inseam, outseam, sleeve (not shown), and other relevant locations.

A customer or salesperson selects a bodysuit 10 that corresponds to the garment for which the customer is being fitted. For example, if the customer desires trousers, a bodysuit 10 as shown in FIGS. 2–4 which covers only the lower torso and legs may be selected. The customer puts on bodysuit 10 and aligns benchmarks 12*a–n* to correspond with the specific measuring points, such as joints or other bodily features. For instance, to be fitted for trousers, a customer puts on bodysuit 10 and, depending on the type of trouser desired, aligns one of benchmarks 12*i–j* with his or her waistline. Benchmarks 12*g, e, b* and a are aligned with the widest parts of the seat, thigh, knee, and ankle, respectively.

Figure 15:
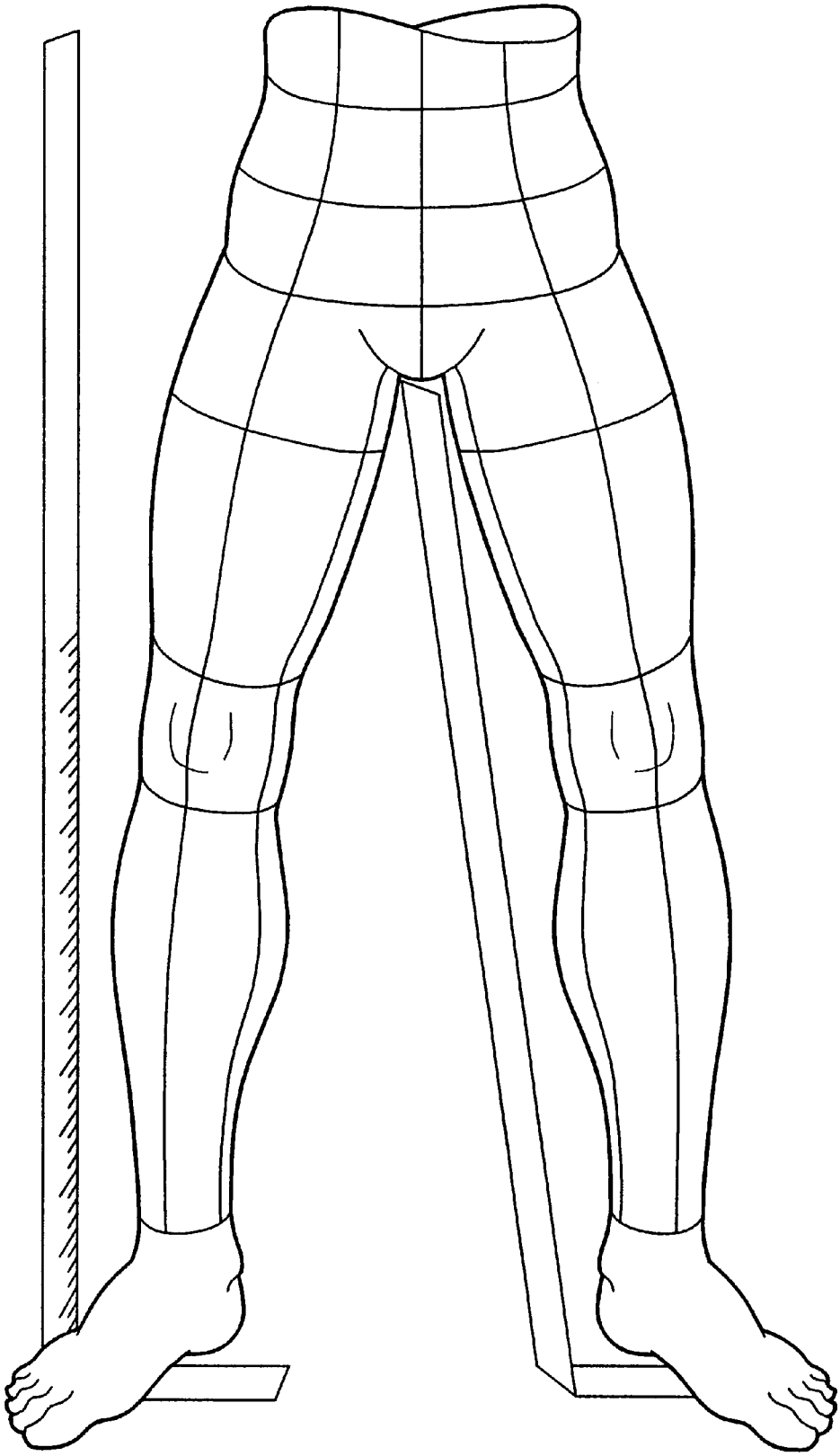
FIG. 15 illustrates the use of the tape measure to take elevation measurements.

When taking measurements manually, the customer or salesperson uses a tape measure to measure both the elevation and circumference of critical measuring points. The tape measure of the preferred embodiment has a rigid end and/or sliding indicator. The rigid end allows the user to stand on the rigid portion, as shown in FIG. 15, and measure the critical elevations. In addition, the rigid end allows the user to take the full or partial rise measurement without assistance. The user simply secures the rigid end into the waistband at the back of the bodysuit and pulls the tape between his or her legs up to the front of his or her waist. The rigid end can be made from a variety of rigid materials, including but not limited to wood, plastic, or metal. The sliding indicator is preferably made from plastic or metal, although any suitable material may be used. One embodiment of the tape measure provides a tape with thousands of tiny dots printed on it. The sliding indicator has a complementary pattern whereby upon sliding the indicator along the tape, the relevant measurements are displayed by virtue of the resulting interference pattern. In yet another embodiment, the sliding indicator has an electro-optical encoder and a liquid crystal display (LCD) so that as the indicator is positioned along the tape, the LCD displays the appropriate measurement. While the above-mentioned tape measures would provide more accurate measurements, a normal tape measure can nonetheless also be used.

The customer first inserts the tape measure through the sliding indicator, similar to how one inserts a belt through a buckle. As shown in FIG. 15, the customer then steps on the rigid end of the tape measure, extends the tape to the correct height as indicated by the benchmarks on the suit, and positions the sliding indicator at that appropriate elevation. For instance, the customer or salesperson measures the inseam and outseam, e.g., by having the customer step on one end of a tape measure and measuring the distance along reference lines 14*a* and 14*b* from the floor to crosshairs 13*a* and 13*b,* respectively (FIG. 2). Use of the sliding indicator results in more accurate measurements as it allows the user to position the indicator at the correct height on the tape measure, step off of the tape measure if he or she desires, and read the measurement. This alleviates the customer's straining to read the measurement while still standing on the tape or, even worse, using a finger to mark the correct measurement, methods that may jeopardize measurement accuracy.

The customer then measures the circumference of each relevant body part, using the respective benchmarks as a guide to properly placing the tape measure. For example, to measure the customer's upper thigh, the customer measures the circumference of benchmark 12*e* (FIGS. 2–4). The salesperson or customer inserts one end of the tape measure through the sliding indicator, fashioned like a belt buckle, and positions the tape around the thigh in alignment with benchmark 12*e.* The sliding indicator is then positioned at the correct measurement. Once again, the indicator eliminates potential measurement error by obviating the need for the user to hold the two ends of the measuring tape together by hand. Moreover, the indicator enables a salesperson to accurately read the measurement without touching the customer, thus lessening the invasiveness of the process.

It is vital to the proper fit of the resulting garment that the circumference of the body part (the upper thigh in this example) be measured at the precise point where the elevation measurement was taken. The present invention, with its benchmarks and reference lines, guides the user in measuring circumferences that directly correspond to elevations and vice versa.

Measurements may be taken directly from a single benchmark; by reference to two or more benchmarks, reference lines or crosshairs; or by reference to one or more benchmarks and other reference points, such as the floor. Benchmarks 12 and reference lines 14 may include fastening means, such as hook and loop fasteners, which allow a tape measure to be removably affixed to bodysuit 10.

Figure 9:
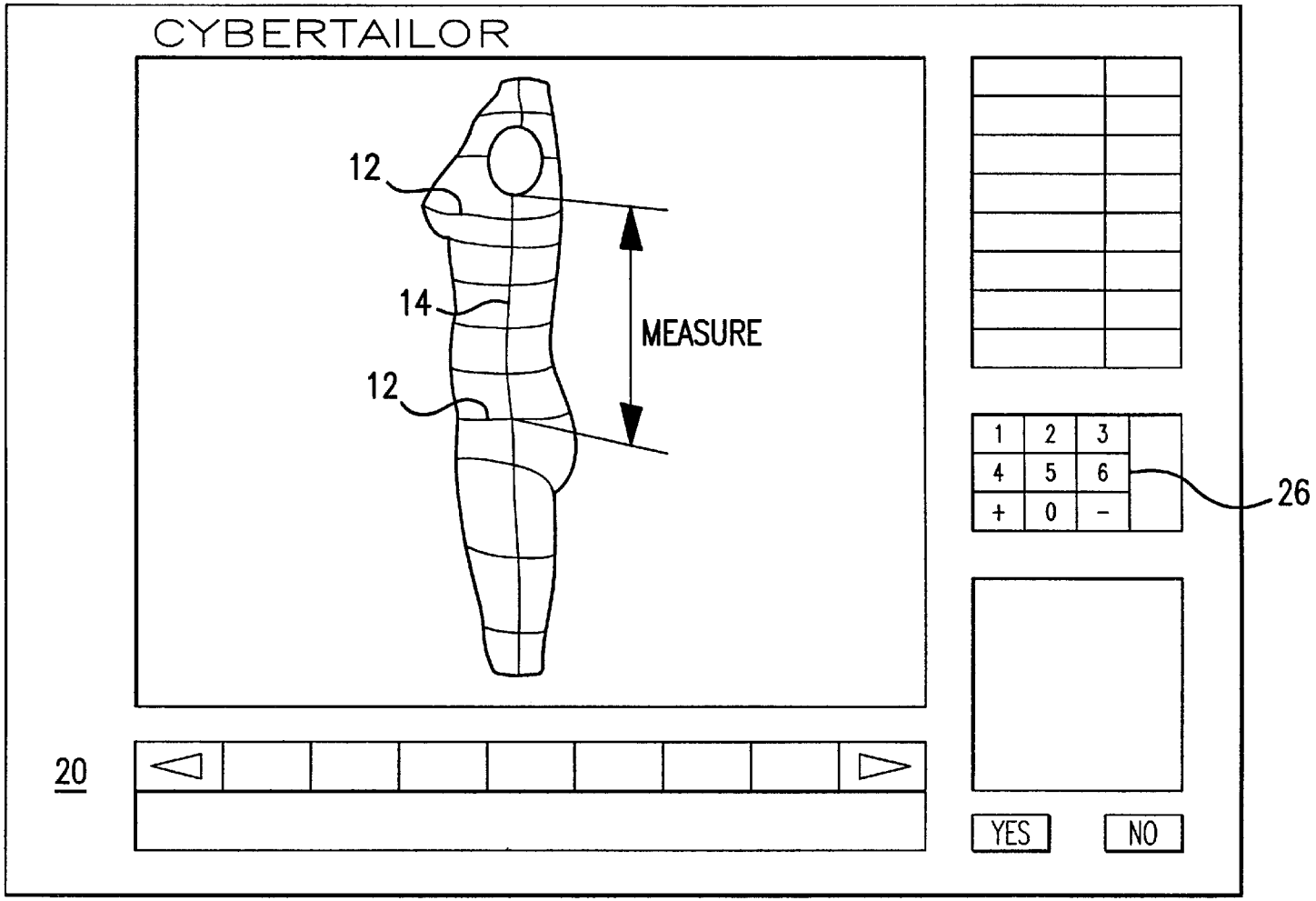
FIG. 9 illustrates a graphical user interface (GUI) of a software application in accordance with the present invention.

Correct adjustment or application of benchmarks 12*a–n* may be directed by a salesperson who is trained in the use of the garment and familiar with the measurements required for garment production. Alternatively, the adjustments may be made by the customers themselves or by the salesperson based on detailed written instructions. Alternatively, as shown in FIG. 9, the user may be prompted by computer software which displays instructions on a display screen or monitor of a computer 20. The computer software may be a conventional Windows-based or other application which uses a graphical interface to guide or prompt the user in the proper application and adjustment of bodysuit 10. Moreover, input fields 26 may be provided, which allow the user to input (if necessary) measured dimensions into a database for use as described below. The dimensions may be input into the database by means of a keypad (not shown) or other data input mechanisms, such as a mouse.

Figure 10:
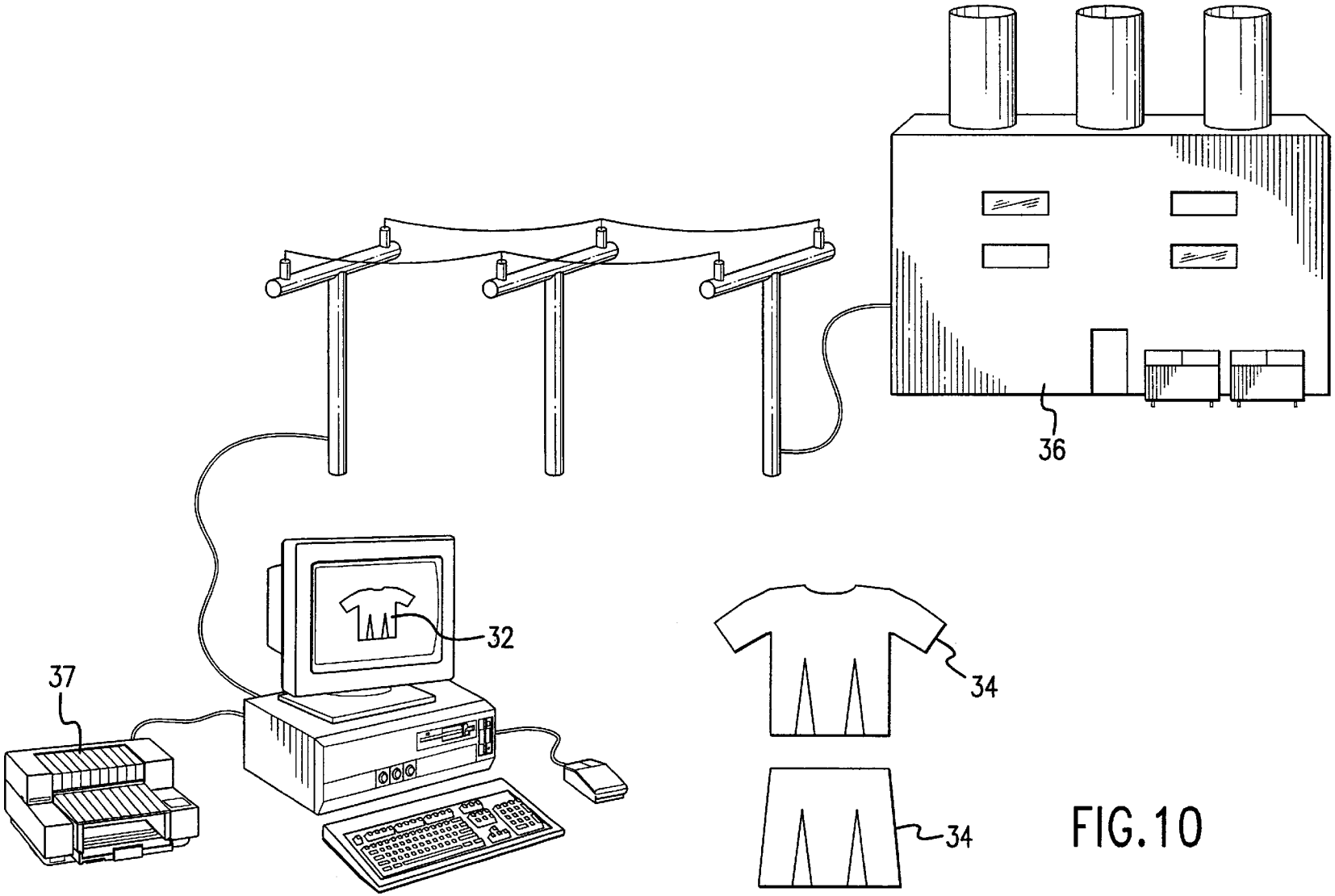
FIG. 10 is a functional diagram illustrating an integrated custom-fit apparel system in accordance with the present invention.

From the measured dimensions of the enclosed portion of the body, a computer application resident on computer 20 can generate a custom fitted pattern 34 for the desired garment. As shown in FIG. 10, pattern 34 can be printed out on a printer 37 for the customer. Alternatively, the measurements may be transmitted directly to clothing manufacturer 36 whereupon pattern generation software resident on computers at the manufacturing site may then generate the desired patterns 34.

Figure 11:
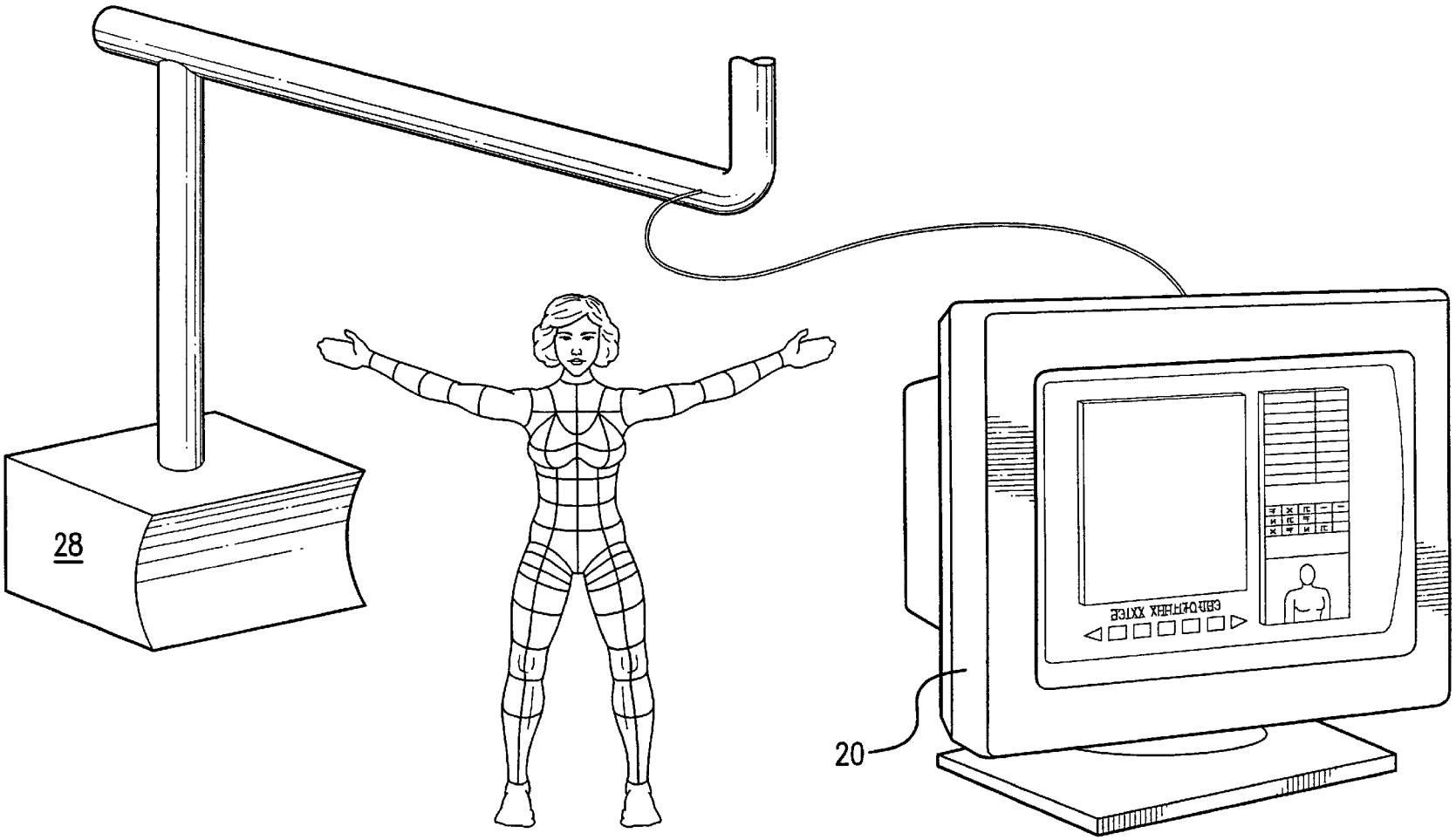
FIG. 11 illustrates an electronic dimension acquisition system in accordance with the present invention.

In alternative embodiments, the measurements of bodysuit 10 may be acquired directly from bodysuit 10 by computer 20. For example, as illustrated in FIG. 11, an optical scanner 28 may be used to acquire a scanned image of the bodysuit 10. Any appropriate optical scanning method or mechanism may be used. Computer 20 then uses optical image manipulation software to determine the critical measurements of the scanned image. One such scanning system, the Body Measurement System ("BMS") produced by [TC]$^2$, is designed to scan a body and extract the critical measurements from the raw scan data. More information about BMS is available at www.TC2.com.

The bodysuit facilitates the computer's identification of the critical areas to be measured. As explained above, the user of the suit adjusts the suit so that the benchmarks and reference lines coincide with the critical measurement areas. In the preferred embodiment, the benchmarks and reference lines are white. By properly calibrating the cameras on the scanner, the scanner can be set to read or scan only white images, i.e., the benchmarks and reference lines on the suit. Therefore, the scanner only captures and transmits images of the critical areas. The computer then determines the measurements from these images.

Figure 5:
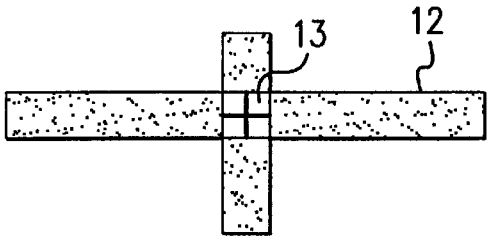
FIG. 5 is a plan view of a crosshair for use on a bodysuit in accordance with the present invention.
Figure 6:
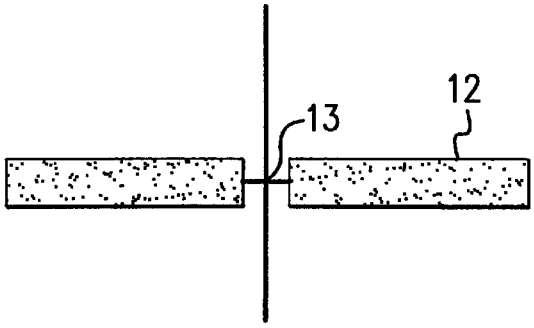
FIG. 6 is a plan view of an alternative embodiment of the crosshair of FIG. 5.
Figure 7:
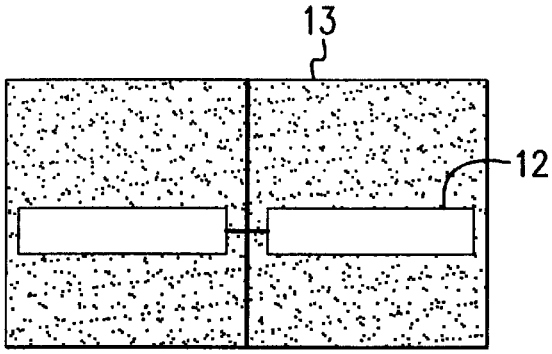
FIG. 7 is a plan view of another alternative embodiment of the crosshair of FIG. 5.
Figure 8:
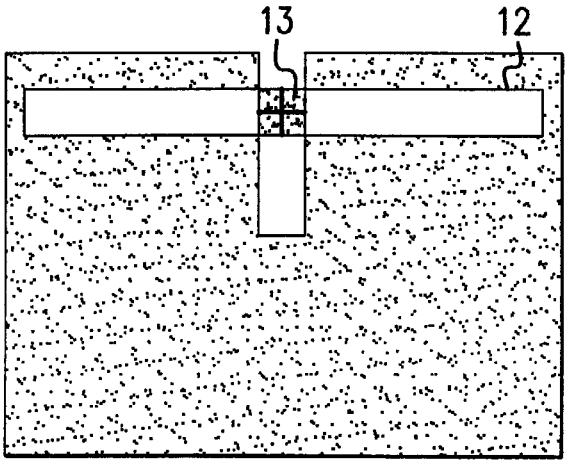
FIG. 8 is a plan view of yet another alternative embodiment of the crosshair of FIG. 5.

Differences in the crosshairs at the intersections of the benchmarks and reference lines, as shown in FIGS. 5–8, enable the computer to differentiate between the different benchmarks and associate the correct measurement with the correct benchmark. For example, in FIG. 2, benchmark 12*a,* located at the ankle of bodysuit 10, may have a crosshair 13 as shown in FIG. 5, whereas benchmark 12*c,* located at the knee, has a crosshair 13 as shown in FIG. 6. These crosshairs 13 are designed to be distinguishable by an optical scanning unit and allow the measuring system to differentiate between benchmarks 12*a* and 12*c.* As shown in FIGS. 5–8, one possible way of distinguishing the different crosshairs is to use a different square matrix configuration for each one. Once the correct measurements are calculated, the measurements may then be downloaded to a database for use by the pattern generating software.

Figure 12:
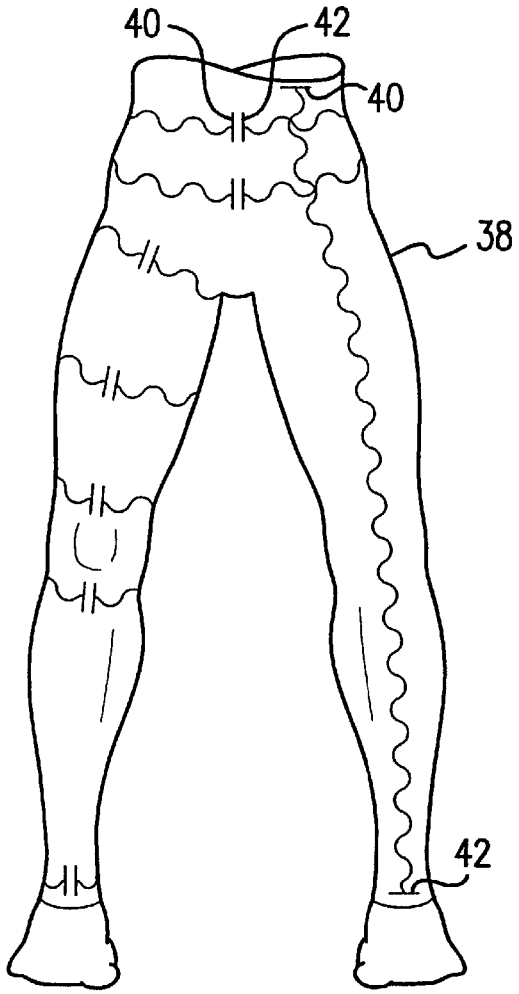
FIG. 12 is a front view of a second alternate embodiment of the bodysuit of FIG. 1.
Figure 13:
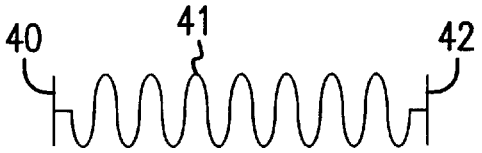
FIG. 13 illustrates a dimensional sensor for use in the bodysuit of FIG. 12, shown in the relaxed position.
Figure 14:
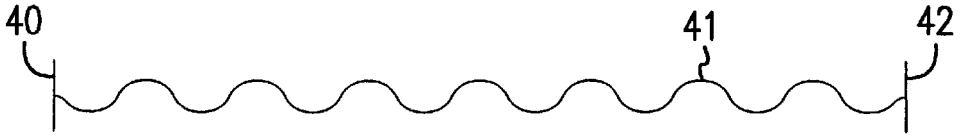
FIG. 14 illustrates a dimensional sensor for use in the bodysuit of FIG. 12, shown in the stretched position.

Alternatively, as shown in FIGS. 12–14, measurements may be electronically acquired through sensors 38 incorporated directly into bodysuit 10. Any appropriate sensor capable of generating a signal proportional to the measurement between two points on bodysuit 10 may be employed.

For example, sensor 38 may include a conducting fiber or guide 41, emitter 40, and detector 42. The signal emitted by emitter 40 can be electrical, optical, acoustic, or any other suitable signal. The signal travels through guide 41 and is received by detector 42. The strength of the signal detected by detector 42 is related to the distance between emitter 40 and detector 42 and is determined through conventional signal processing techniques.

To measure the dimensions of a portion of a customer's body using sensor 38, the customer would enclose the portion of his or her body in bodysuit 10, which has at least one sensor 38 attached to the suit. Sensor 38 may communicate with a computer or other data recording device. For instance, detector 42 may transmit a microwave, infrared or other radio frequency signal to a receiver on the computer. Software resident on the computer determines the dimensions of the enclosed portion of the body based on the data received from detector 42. The dimensions may then be used in one of the ways described above.

Figure 16:
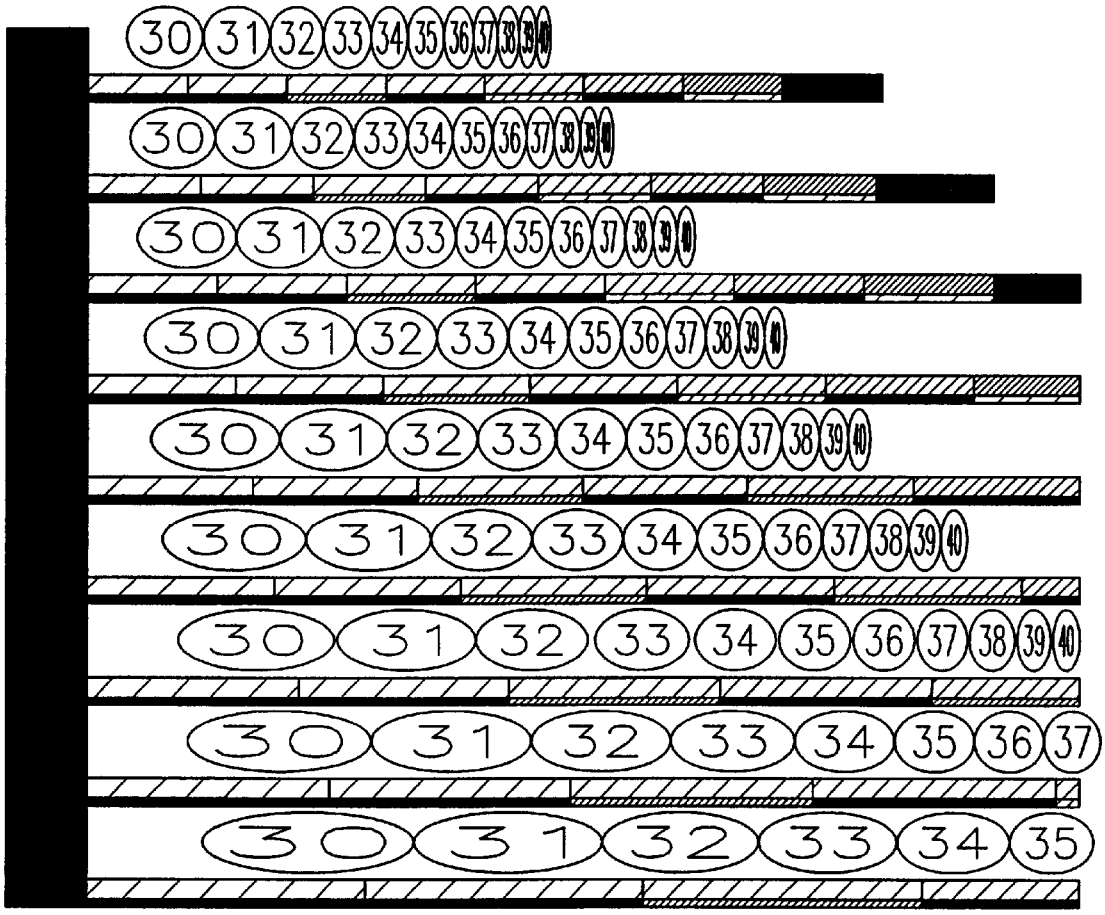
FIG. 16 illustrates benchmarks consisting of figures instead of lines.

Alternatively, as shown in FIG. 16, the benchmarks and reference lines of the invention can consist of elastic bands that are marked in such a manner that the stretching of the elastic band that results when the user dons the suit distorts the markings such that a marking corresponding to the correct measurement is visibly distinct from the other markings. For example, as shown in FIG. 16, the benchmarks, instead of being solid lines, may consist of consecutive circle-like figures containing numbers that represent measurements. When the user properly adjusts the suit to align the benchmarks with the critical areas of the body, the shape of all but one of the circle-like figures distorts. One circle-like figure will instead form a perfect circle. The number in this circle indicates the correct measurement of that body part. For each benchmark, the user can visually determine which figure indicates the correct measurement. In this case, the user can identify which circle-like figure of each benchmark forms a perfect circle when the suit is on the user, thus indicating the correct measurement of each critical body area. Alternatively, a scanning system can also gauge the correct figure and thus precise measurement of the body part.

Figure 19:
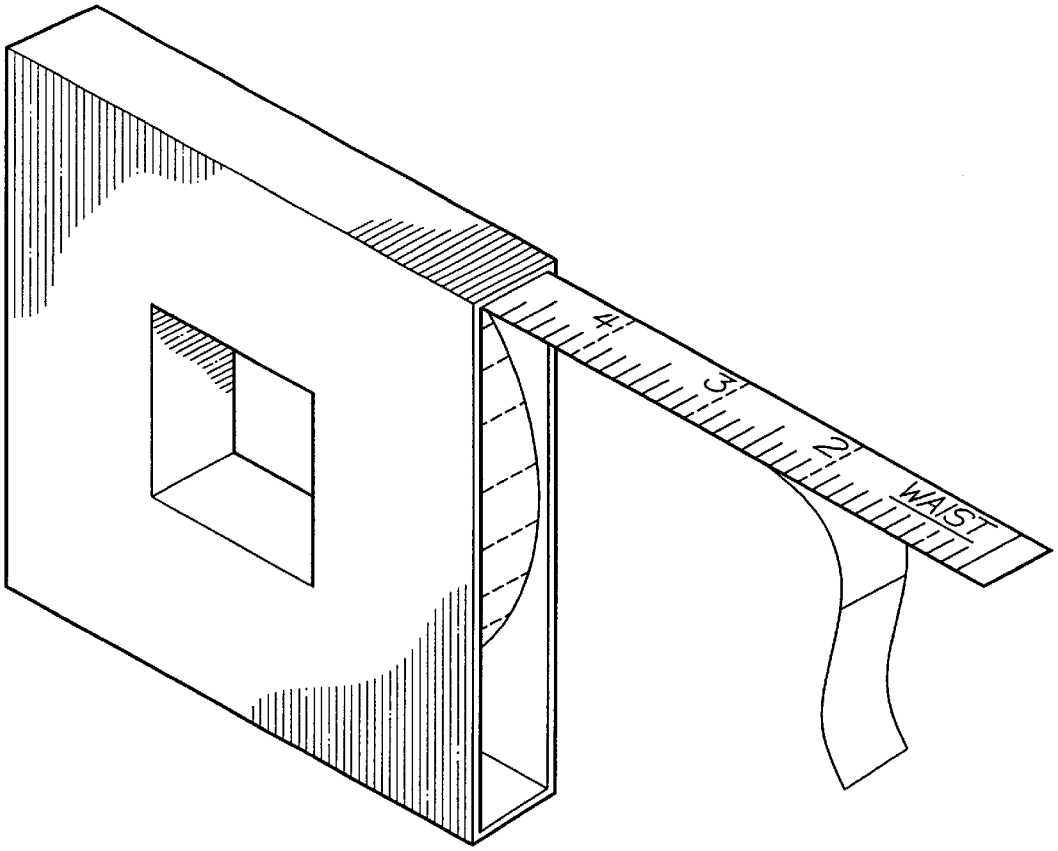
FIG. 19 illustrates a roll of adhesive measuring tape.
Figure 20:
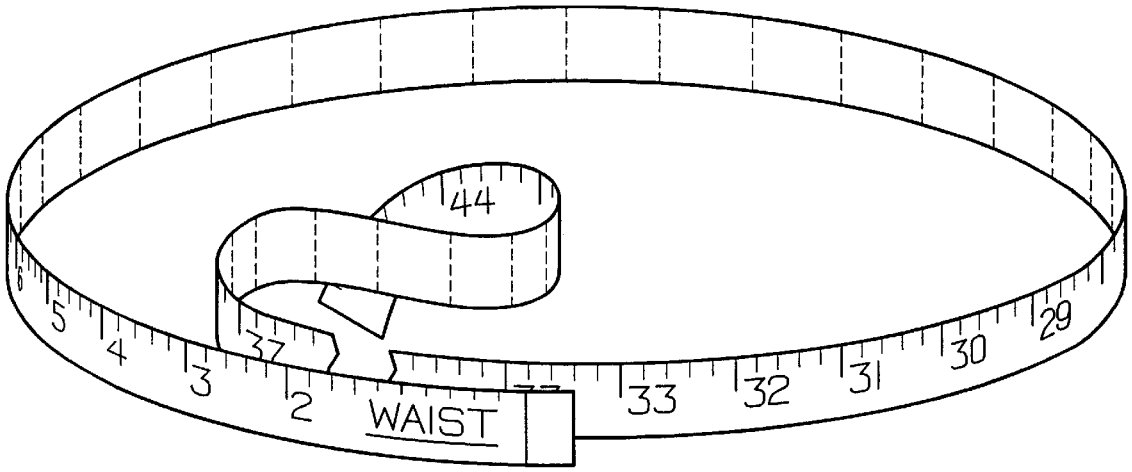
FIG. 20 demonstrates the proper location at which to detach the measuring tape.

Other embodiments of this invention allow for accurate measurement acquisition without the use of the body suit. Once such embodiment uses an adhesive measuring tape, as shown in FIG. 19. The user simply wraps the tape around the critical body parts identified in FIG. 17. A different tape is provided for each critical body part. For example, to measure the waist, the user selects the tape that corresponds to the waist, then simply wraps the tape around his or her waist. The user can apply the tape directly to his or her skin or alternatively to a form-fitting undergarment. Once the tape is entirely around the user's waist and begins to overlap with the underlying layer of tape, the user simply tears the tape at the measurement closest to the position where the overlap begins, as shown in FIG. 20. The location where the tape is torn indicates the correct measurement of the waist. The tape is preferably perforated at regular intervals to make this process more precise. The user repeats this process for every critical body part, using a different tape for each iteration.

Figure 21:
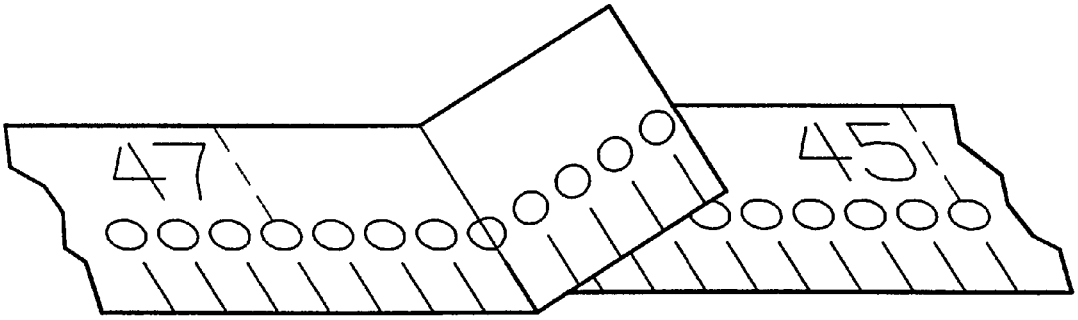
FIG. 21 demonstrates the proper creasing of the measuring tape.
Figure 22:
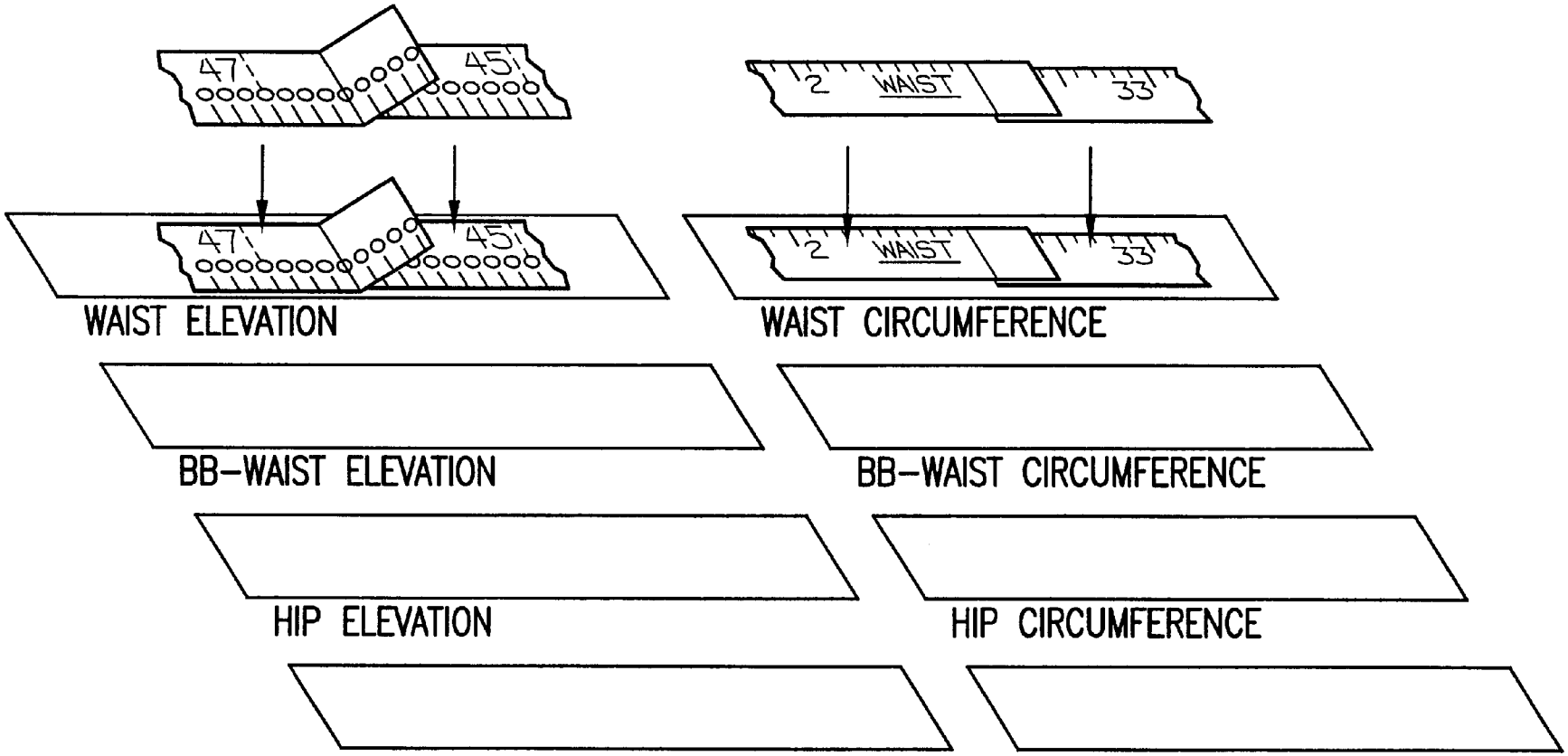
FIG. 22 demonstrates adhering the tape stubs to the measurement form.

Once the circumferences of the critical body parts are measured but before the tape is removed, the user measures the elevation of each body part. This can be done in the same way that the elevation measurements are acquired if the user was wearing the bodysuit, as discussed previously. Alternatively, different tapes may be provided for each critical elevation. The user would then simply use a different tape for each critical elevation measurement and detach the tape at the correct elevation of each body part, similar to how the user measured the circumferences. Yet another alternative provides the user with an adhesive measuring tape whereby the user simply creases the tape at the critical elevations, as shown in FIG. 21. Once all of the critical circumferences and elevations are measured, the user adheres the tape stubs to the measurement form, making sure to indicate which stub relates to which body part, as shown in FIG. 22. Upon receipt of the sheet, the supplier knows the correct height and elevation measurements of each body part by simply looking at the tape stubs. The supplier can then generate patterns and produce the garments accordingly.

Figure 17:
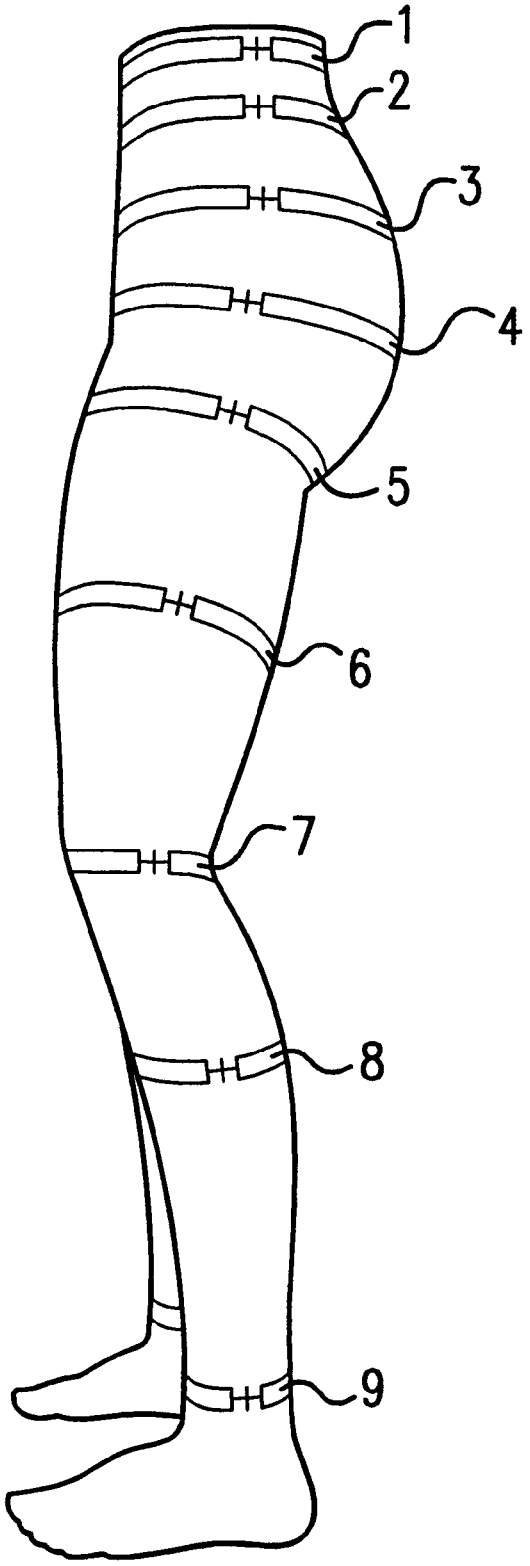
FIG. 17 illustrates a measurement acquisition system without the use of the bodysuit.

Yet another embodiment not involving the bodysuit provides the user with a number of labels indicating the critical body parts, as shown in FIG. 18. The user positions the labels down the side of his or her body at the appropriate locations as indicated in FIG. 17. The user can then use a measuring tape to take both circumference and elevation measurements.

The foregoing is provided for purposes of illustration, explanation, and description of embodiments of the present invention. Modifications and adaptations to these embodiments will be apparent to those skilled in the art and may be made without departing from the scope or spirit of the invention.

What is claimed is:

1. A method of acquiring measurements of the dimensions of a portion of a human body, comprising the steps of:

a) enclosing the portion in an expandable article of clothing which is marked with at least one benchmark;

b) positioning the benchmark to coincide with a predetermined location on the portion wherein the benchmark corresponds to a unique location;

c) measuring a dimension of the benchmark; and d) providing a visual display of text or graphics which explains to a user how properly to position the benchmark with respect to the corresponding predetermined location.

2. The method of claim 1, further comprising the step of entering the measured dimension into a database.

3. The method of claim 2, further comprising the steps of electronically reading the dimension and creating a custom fitted pattern.

4. The method of claim 1 in which the step of measuring the dimension of the benchmark further comprises the step of affixing a measuring device to the article of clothing.

5. The method of claim 1, in which the step of measuring the dimension of the benchmark is performed by optically scanning the article of clothing, identifying the benchmark, and measuring the length of the benchmark.

6. The method of claim 1, in which said step of measuring the dimension of the benchmark is performed by electronically acquiring the dimensions from at least one sensor integrated in the article of clothing in which the location of the sensor corresponds to the location of the benchmark.

7. The method of claim 1 further comprising the step of measuring at least one linear distance between the benchmark and either another benchmark or an external reference point.

8. An apparatus for acquiring custom measurements of the dimensions of a portion of a human body comprising an expandable article of clothing marked with a plurality of benchmarks, in which each of the benchmarks is positioned so as to coincide with predetermined locations on a human body, the dimensions of which are useful for fitting a garment, and further comprising an optical scanner for use in conjunction with the article of clothing in which the benchmarks comprise crosshairs and are coded in such a manner as to allow the optical scanner to differentiate between each of the benchmarks.

9. The apparatus of claim 8, further comprising a software application resident on a computer in communication with the optical scanner for generating a custom fitted pattern.

10. The apparatus of claim 9, further comprising a plurality of reference lines.

11. A system for producing custom-fitted garments comprising:

a) a bodysuit marked with a plurality of benchmarks and reference lines in which each of the benchmarks corresponds to a predetermined location on a human body;

b) a measuring device adapted to measure dimensions of the benchmarks and reference lines; and c) a first application resident on a computer for prompting a user to apply and adjust the bodysuit with respect to the predetermined location.

12. The system of claim 11, further comprising an input mechanism for inputting the dimensions into the first application.

13. The system of claim 12 in which the input mechanism is a key pad.

14. The system of claim 12 in which benchmark and reference lines are coded with crosshairs and the input mechanism is an optical scanner in communication with the first application and capable of scanning and differentiating the crosshairs.

15. The system of claim 12 in which the measuring device is a sensor incorporated in the bodysuit and the input mechanism is a remote receiver in communication with the sensor and the first application.

16. The system of claim 12, further comprising a transmitting mechanism for transmitting the measurements from the first application to a second computer at a manufacturing facility.

17. The system of claim 16, further comprising a second application resident on the second computer for generating a custom fitted pattern.

18. The method of claim 1, in which the step of measuring the dimension of the benchmark is performed by identifying a correct figure of the benchmark and reading the corresponding measurement.

19. The apparatus of claim 8 in which each benchmark further comprises figures corresponding to measurements whereby the proper measurement of a body dimension is determined by identifying the correct figure of the benchmark.

20. The system of claim 11 in which the benchmarks further comprise figures corresponding to measurements whereby the proper measurement of a body dimension is determined by identifying the correct figure of the benchmark.

* * * * *